US011447314B2

(12) United States Patent
Hsieh

(10) Patent No.: US 11,447,314 B2
(45) Date of Patent: Sep. 20, 2022

(54) LOCK PACKING BOX AND SEPARATION STRUCTURE OF LOCK PACKING BOX

(71) Applicant: TAIWAN FU HSING INDUSTRIAL CO., LTD., Kaohsiung (TW)

(72) Inventor: Wan-Lin Hsieh, Kaohsiung (TW)

(73) Assignee: Taiwan Fu Hsing Industrial Co., Ltd., Kaohsiung (TW)

( * ) Notice: Subject to any disclaimer, the term of this patent is extended or adjusted under 35 U.S.C. 154(b) by 5 days.

(21) Appl. No.: 16/953,778

(22) Filed: Nov. 20, 2020

(65) Prior Publication Data

US 2022/0161977 A1 May 26, 2022

(51) Int. Cl.
*B65D 57/00* (2006.01)

(52) U.S. Cl.
CPC ..... *B65D 57/003* (2020.05); *B65D 57/005* (2020.05)

(58) Field of Classification Search
CPC .. B65D 57/005; B65D 57/003; B65D 5/5059; B65D 5/5038; B65D 5/5042; B65D 71/0077
USPC ..... 206/223
See application file for complete search history.

(56) References Cited

U.S. PATENT DOCUMENTS 3,407,921 A * 10/1968 Cilluffo ..... B65D 5/5038 206/418
3,841,472 A * 10/1974 Fuller ..... B65D 73/02 206/728
4,307,803 A * 12/1981 Johnson ..... B65D 75/36 206/321
10,160,571 B2 * 12/2018 Chen ..... B65D 5/505

* cited by examiner

*Primary Examiner* — Anthony D Stashick
*Assistant Examiner* — Raven Collins
(74) *Attorney, Agent, or Firm* — Rosenberg, Klein & Lee

(57) ABSTRACT

A separation structure includes a support seat having at least one passage defined transversely therethrough. At least two notches are defined from the top of the support seat. Each notch includes a guide portion and a positioning portion. The guide portion opens through the top of the support seat and narrows toward the root portion of the support seat. The positioning portion communicates with the guide portion. The transmission part of a lock is positioned in the positioning portion of the notch via the guide portion. Two operational ends of the lock are located on two sides of the support seat. A user extends his/her finger through the passage to carry the support seat and the locks. The support seats can be piled up to save space.

6 Claims, 10 Drawing Sheets

LOCK PACKING BOX AND SEPARATION STRUCTURE OF LOCK PACKING BOX

BACKGROUND OF THE INVENTION

1. Fields of the Invention

The present invention relates to a lock packing box and a separation structure of the lock packing box, the support seats of the packing box can be piled up to arrange multiple locks so that the users can carry multiple locks by one hand.

2. Descriptions of Related Art

Packing boxes are used to pack products or goods therein for convenience of transportation and retailing. Some products are required to be packed and sold in one box so that customers may purchase multiple boxes. However, yet some products have a complicated outer profile such as a door lock which is transversely installed to a door so that the users can hold and rotate the handle to unlock the door lock. The door locks are difficult to be accommodated in a box so that the box has to be large enough to pack the door lock therein. This may increase the cost of packing, transportation, stocking, displaying and selling.

One of the lock packing boxes known to applicant is disclosed in Taiwanese Patent No. M535213 which discloses a lock packing box to arrange multiple door locks inclinedly and alternatively. A separator is put between the adjacent locks to prevent from impact each other. This arrangement can ensure that the packing boxes are well positioned when being piled up to reduce the volume of the packing boxes and to save storage space. Nevertheless, only one lock can only be picked and installed, and it is inconvenient to unpack the packing box. Besides, a significant separator is required to be put between the adjacent locks, and that requires more packing material.

The present invention intends to provide a lock packing box and a separation structure of the lock packing box, allowing the locks and the support seats to be piled up to eliminate shortcomings mentioned above.

SUMMARY OF THE INVENTION

The present invention relates to a separation structure and comprises a support seat having at least one passage defined transversely therethrough. At least two notches are defined from the top of the support seat, and each notch includes a guide portion and a positioning portion. The guide portion opens through the top of the support seat and narrows toward the root portion of the support seat. The positioning portion communicates with the guide portion.

Preferably, the guide portion and the positioning portion form each notch as a Y-shaped notch.

Preferably, the support seat includes a board which is bent along a bending line. The at least one passage is formed by at least two holes of the board. The notch is formed by the board with at least two openings that communicate with each other.

Preferably, the support seat has two passages. The support seat includes odd number of the notches. One of the notches is located between the two passages.

Preferably, at least one plate is engaged with the support seat from the underside of the support seat.

Preferably, at least one first slot is defined in the underside of the support seat. The at least one plate includes second slot defined in the top edge thereof. The underside of the support seat is inserted in the second slot. The inner bottom of the second slot is inserted into the at least one first slot, so that the at least one plate is perpendicularly combined with the support seat.

The present invention also provides a lock packing box and comprises multiple locks. At least one of the locks includes two operational ends which are located corresponding to each other. A transmission part is located between the two operational ends. A separation structure is located in the lock packing box and includes at least one support seat. The at least one support seat has at least one passage defined transversely therethrough. At least two notches are defined from the top of the at least one support seat. Each notch includes a guide portion and a positioning portion. The guide portion opens through the top of the at least one support seat and narrows toward the root portion of the at least one support seat. The positioning portion communicates with the guide portion.

The transmission part of one of the locks is engaged with the positioning portion via the guide portion so as to position the lock in the notch. The two operational ends of the lock are located on two sides of the at least one support seat.

Preferably, the at least one support seat includes a board which is bent along a bending line. The at least one passage is formed by at least two holes of the board. The notch is formed by the board with at least two openings that communicate with each other.

Preferably, the operational ends of each lock are a lever handle or a knob handle.

Preferably, the support seats are piled up, and the locks are positioned alternatively.

Preferably, the separation structure includes at least one plate which perpendicularly connected to the at least one support seat from the underside of the at least one support seat.

Preferably, the separation structure includes at least one separator which includes a bridge transversely formed between two arms. The bridge is located in the guide portion of the at least one support seat. The arms are located between the two adjacent operational ends of two locks.

Preferably, the guide portion and the positioning portion form each notch as a Y-shaped notch.

The advantages of the present invention are that the support seats can be piled up to locate the locks in a specific form. When the locks have lever handles, the locks that are located at the lower position are positioned to face the operational ends upward. The locks that are located at the upper position are positioned to face the operational ends downward. The operational ends of the locks of the upper position and the lower position are alternatively arranged so that the locks can be piled up to save storage space and to reduce the volume of the packing box.

The support seat of the present invention includes a passage and can position multiple locks. The user extends a finger through the passage and carries the support seat together with the locks that are positioned to the support seat by one hand.

The locks are wrapped by a bag for protection and aesthetic purposes. In order to prevent the bag from impeding the insertion of the lock into the notch, each notch includes a guide portion and a positioning portion. The guide portion opens through the top of the support seat and narrows toward the root portion of the support seat. The transmission part of the lock is easily inserted into the guide portion and then positioned in the positioning portion to increase the convenience of positioning of the lock relative to the support seat, such that the time cost for packing is effectively reduced.

By the separators located between the operational ends of the locks that are located adjacent to each other, the locks are prevented from impact to each other to keep the flawless outside appearance of the locks. The customers' benefits are also maintained.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
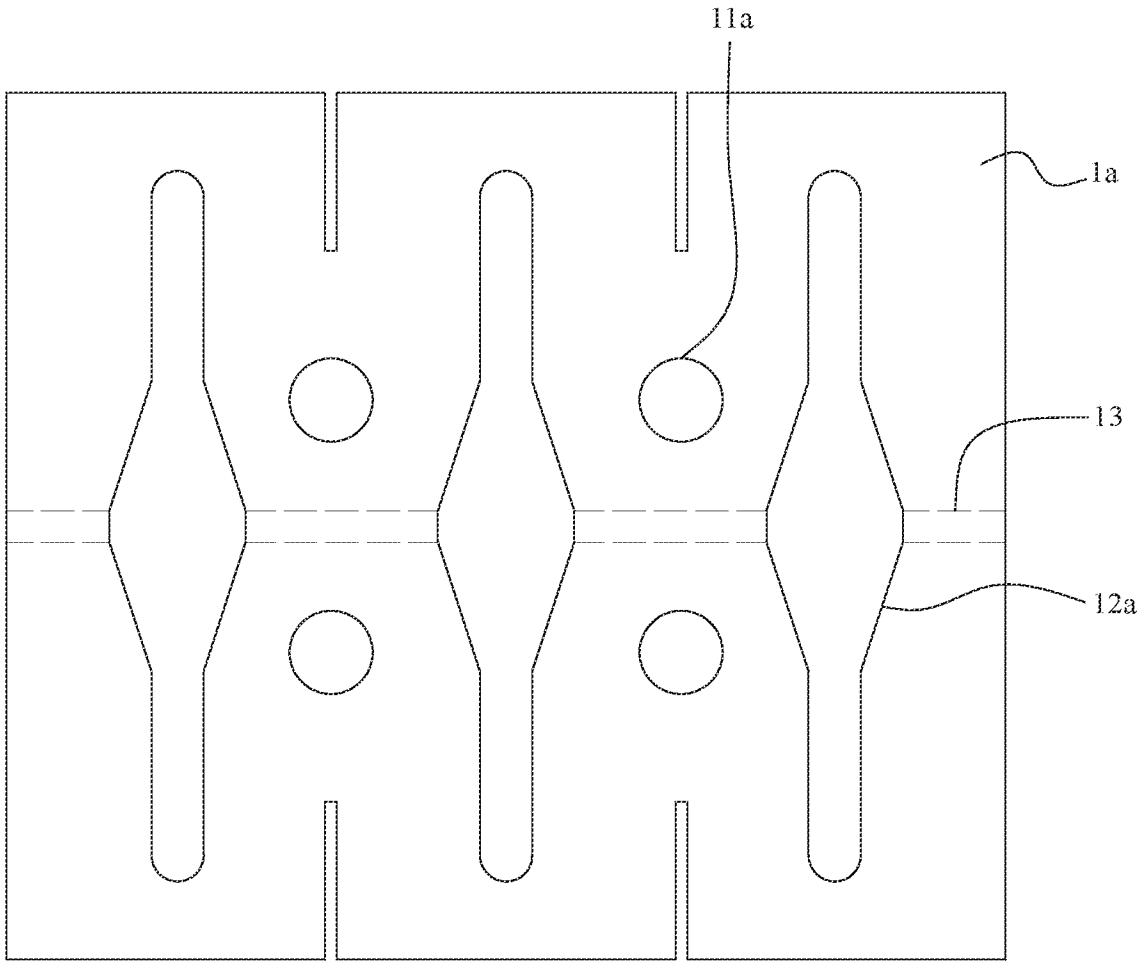
FIG. 1 shows the board of the present invention.
Figure 2:
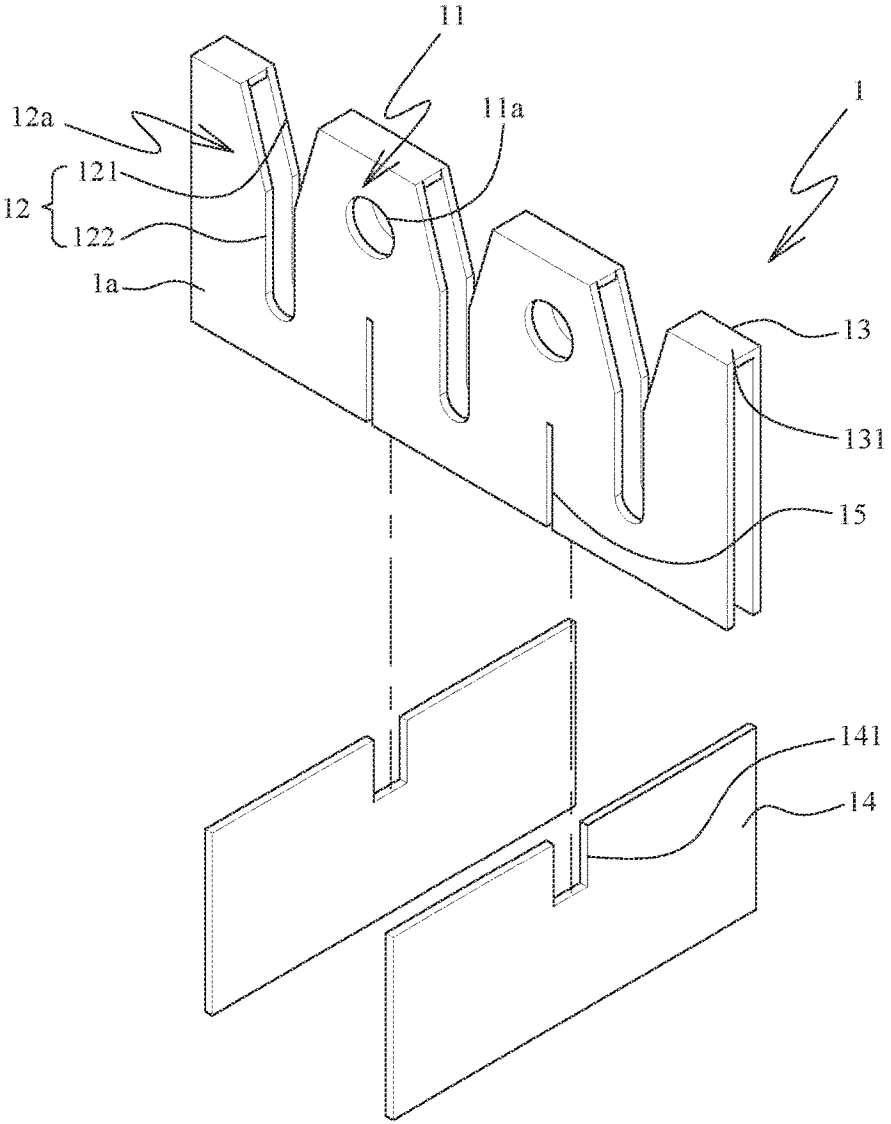
FIG. 2 is an exploded view to show that the board being bent to be a support seat, and the plates of the present invention.
Figure 3:
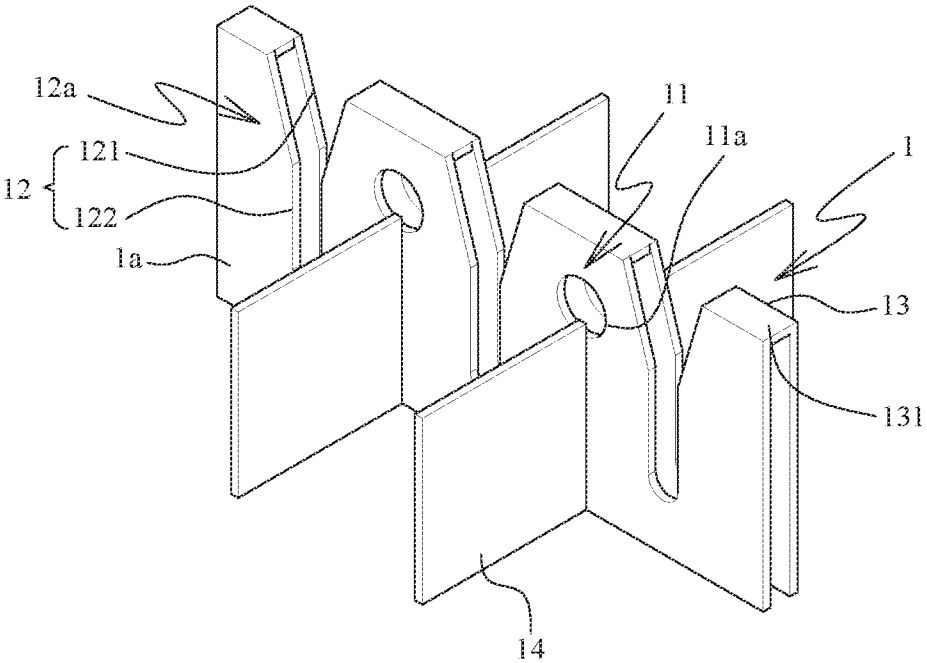
FIG. 3 is a perspective view to show that the plates are combined with the support seat of the present invention.

Referring to FIG. 1, the separation structure of the present invention comprises a support seat 1 having at least one passage 11 defined transversely therethrough. At least two notches 12 are defined from the top of the support seat 1, and each notch 12 includes a guide portion 121 and a positioning portion 122. The guide portion 121 opens through the top of the support seat 1 and gradually narrows toward the root portion of the support seat 1. The positioning portion 122 communicates with the guide portion 121.

Figure 4:
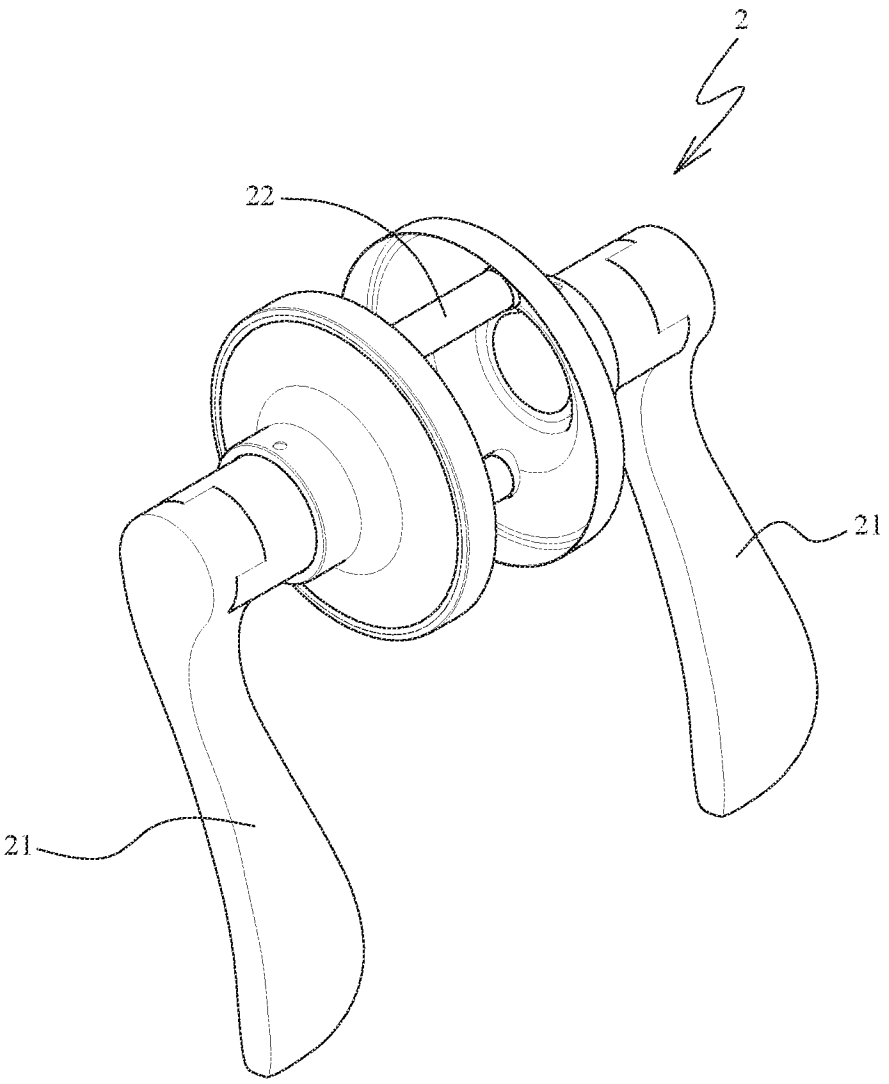
FIG. 4 shows a lock to be packed in the lock packing box of the present invention.
Figure 5:
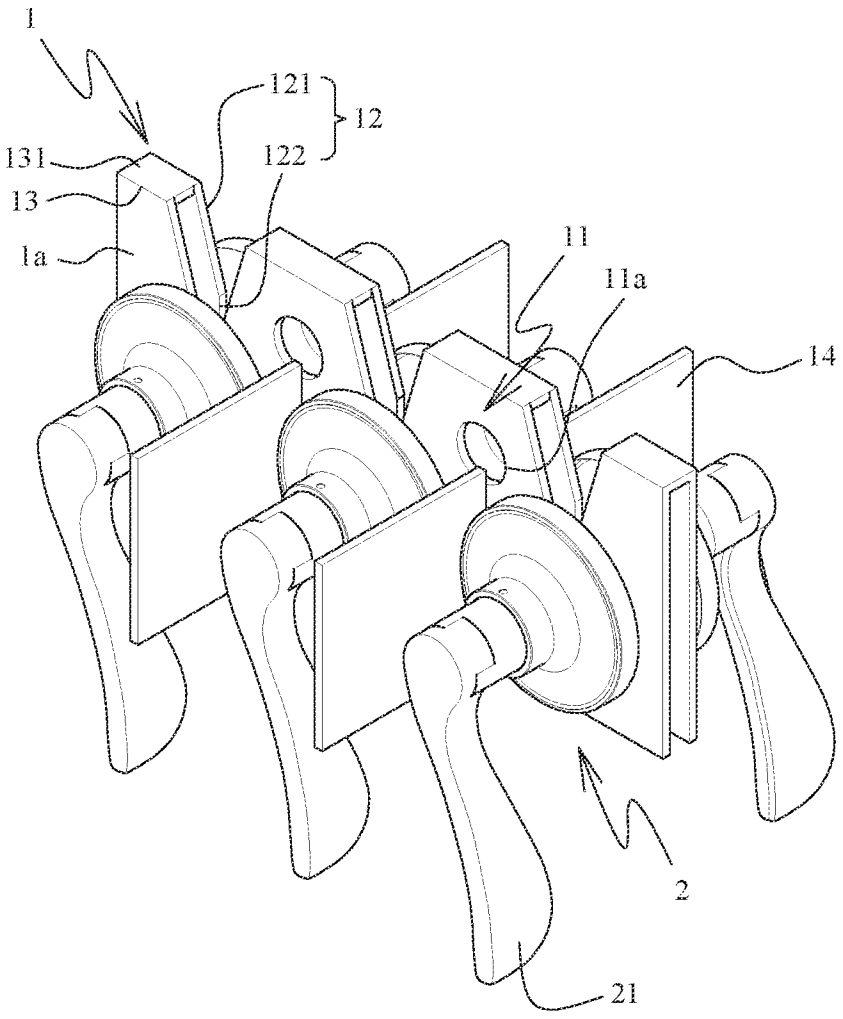
FIG. 5 shows that multiple locks are positioned by the support seat and the plates of the present invention.

The support seat 1 can position multiple locks 2 as shown in FIG. 4, wherein each lock 2 includes two operational ends 21 which are located corresponding to each other, and a transmission part 22 is located between the two operational ends 21. The lock 2 can be installed to a door (not shown) as a door lock. The operational ends 21 can be a lever handle or a knob handle. In this embodiment, the lock is shown with the lever handles. As shown in FIG. 5, the transmission part 22 of one of the locks 2 is engaged with the positioning portion 122 via the guide portion 121 so as to position the lock 2 in the notch 12, and the two operational ends 21 of the lock 2 located on two sides of the at least one support seat 1.

The support seat 1 can be formed by paper or plastic. For environmental and cost-reduction purposes, the support seat 1 includes a board 1*a* which is bent along a bending line 13. The passage 11 is formed by at least two holes 11*a* of the board 1*a*. The notch 12 is formed by the board 1*a* with at least two openings 12*a* that communicate with each other.

Figure 6:
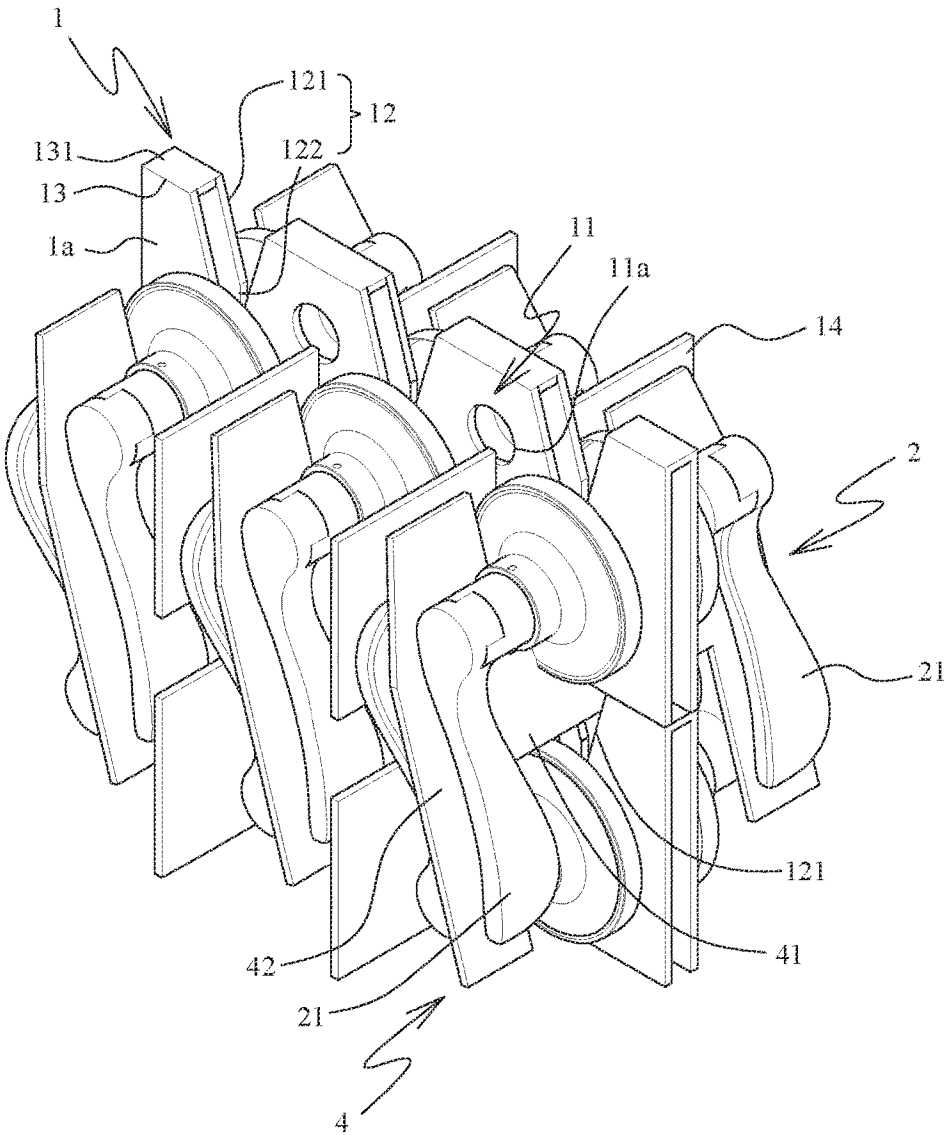
FIG. 6 shows two support seats each positioning three locks are piled up.

The board 1*a* may have two bending lines 13 such that a face 131 is formed when bending the board 1*a* along the bending lines 13. The support seat 1 is then have a thickness to reinforce its strength and support ability. The board 1*a* can be made of paper. The board 1*a* is able to support multiple locks 2 by being bent along the bending lines 13 as mentioned before. As shown in FIG. 6, thanks to the passage 11, the user may extend his/her finger through the passage 11 and lift the support seat 1 together with the locks 2 positioned to the support seat 1. That is to say, the user can carry multiple locks 2 by one hand and that is convenient and efficient in transportation and installation.

In order to keep balance of the support seat 1 with the locks 2 when the user carries so that the locks 2 won't tilt toward one end of the support seat 1, as shown in FIG. 5, the support seat 1 includes two passages 11 for the user to use two fingers to carry the support seat 1. The support seat 1 includes odd number of the notches 12, and one of the notches 12 is located between the two passages 11, and the rest of the notches 12 are located symmetrically to each other relative to the passages 11. By this arrangement, when the support seat 1 is carried, the locks 2 do not fall toward one end of the support seat 1. The description "relative to the passages 11" does not mean that the notches 12 are located symmetrically to each other relative to the centers of the passages 11, when there are even number of passages 11, the notches 12 are located symmetrically to each other relative to the weight center or the line passing through the passages 11.

The guide portion 121 and the positioning portion 122 form each notch 12 as a Y-shaped notch. The guide portion 121 gradually narrows toward the root portion of the support seat 1, so that when the lock 2 is positioned in the notch 12, the user simply put the transmission part 22 in the guide portion 121, and the transmission part 22 is guided by the guiding portion 121 and enters into the positioning portion 122. For protection and aesthetic purposes, the locks 2 are wrapped by a bag (not shown). Although the bag is deformed by the shape of the operational end 21, the bag on the transmission part 22 is still attached to the surface of the operational end 21 when the transmission part 22 is inserted into the wide opened guiding portion 121 and guided by the inclined insides of the guiding portion 121, and then enters into the positioning portion 122. The bag does not affect the positioning feature between the lock 2 and the support seat 1 so as to reduce the time cost of the positioning and packing.

In order to increase the stability of the support seats 1 so that the support seats 1 can be piled up, at least one plate 14 is perpendicularly connected to the underside of the support seat 1 to increase contact area on the underside of the support seat 1. The at least one plate 14 also secures the shape of the board 1*a* that is bent to form the support seat 1, and increase the strength of the support seat 1. In one embodiment, at least one first slot 15 is defined in the underside of the support seat 1. The at least one plate 14 includes a second slot 141 defined in the top edge thereof. The underside of the support seat 1 is inserted in the second slot 141, and the inner bottom of the second slot 141 is inserted into the at least one first slot 15, so that the at least one plate 14 is perpendicularly combined with the support seat 1.

Figure 7:
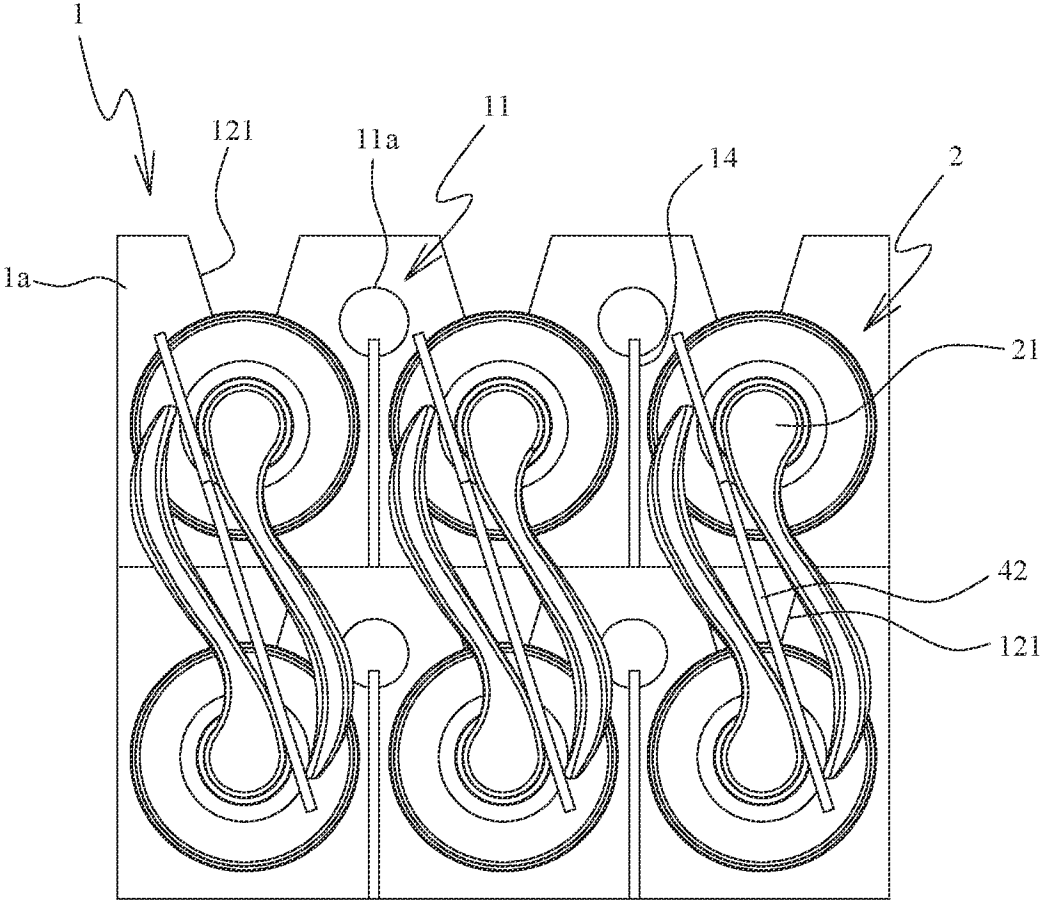
FIG. 7 is a side view of the illustration in FIG. 6.

As shown in FIGS. 6 to 10, the support seats 1 with the locks 2 positioned to the support seats 1 can be put in a box 3, and an accessories pack 31 is located beside the support seats 1. The accessories pack 31 includes necessary parts when installing the locks 2, and is packed within the box 3 for convenience of packing, transportation and display. The support seats 1 are piled upward in the box 3 as shown in FIGS. 6 and 7, the operational ends 21 are located alternatively from each other. For the locks 2 supported by the support seat 1 at the lower position, the operational ends 21 face upward. For the locks 2 supported by the support seat 1 at the upper position, the operational ends 21 face downward. The operational ends 21 of the locks 2 on the upper position and the lower position are alternatively arranged so as to save storage space and to reduce the volume of the packing box. The cost for packing material, transportation, stocking, displaying and sell is reduced.

Figure 8:
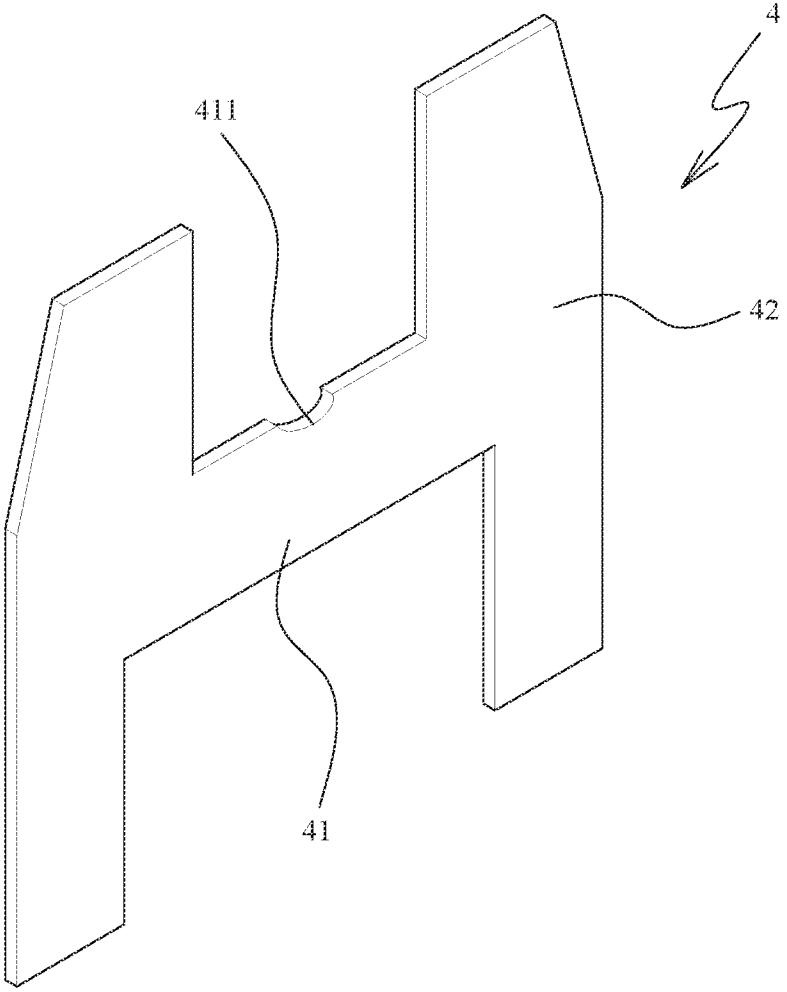
FIG. 8 is a perspective view to show the separator of the present invention.
Figure 9:
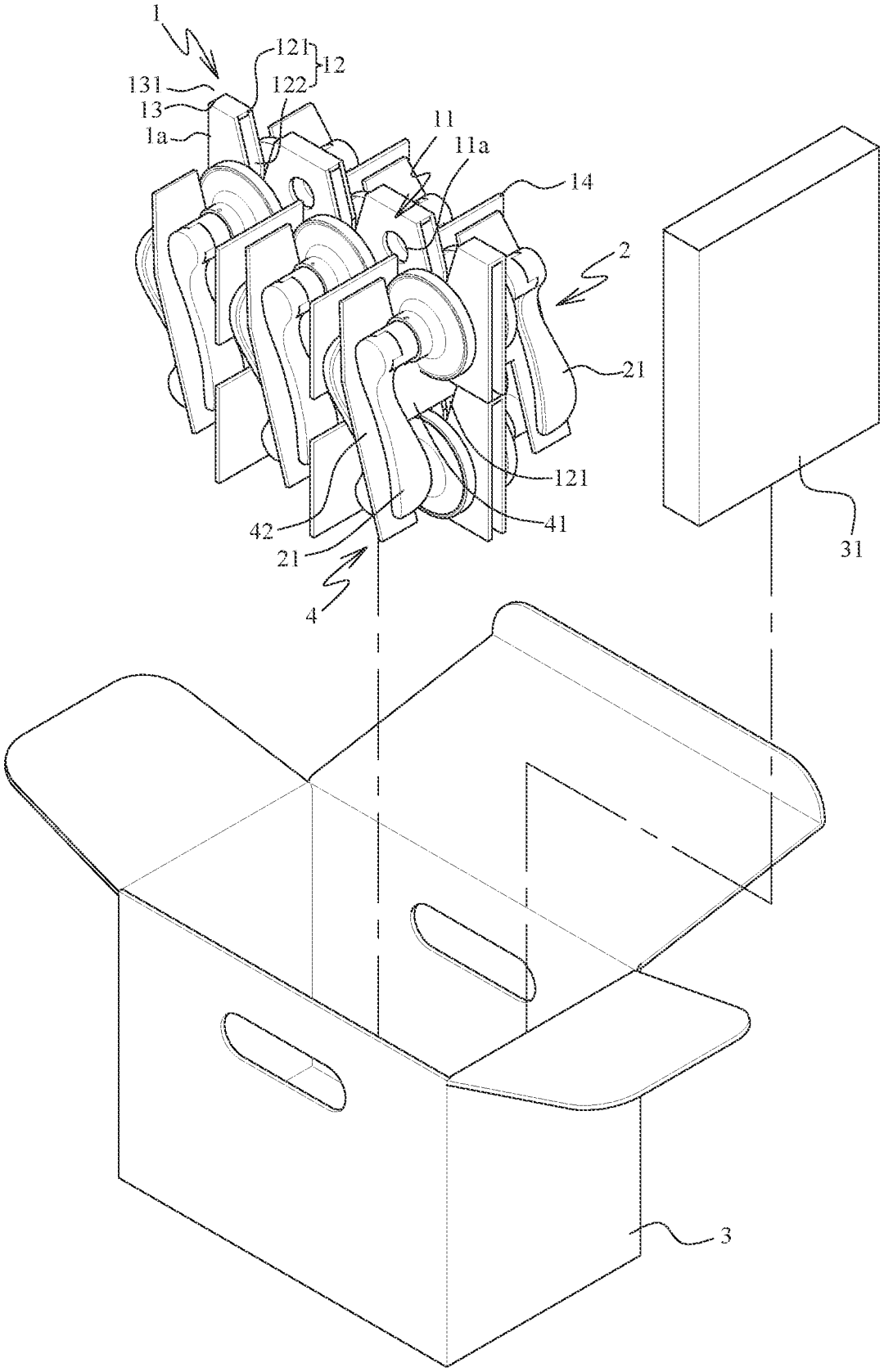
FIG. 9 shows that the piled support seats with locks are to be put in a lock packing box.
Figure 10:
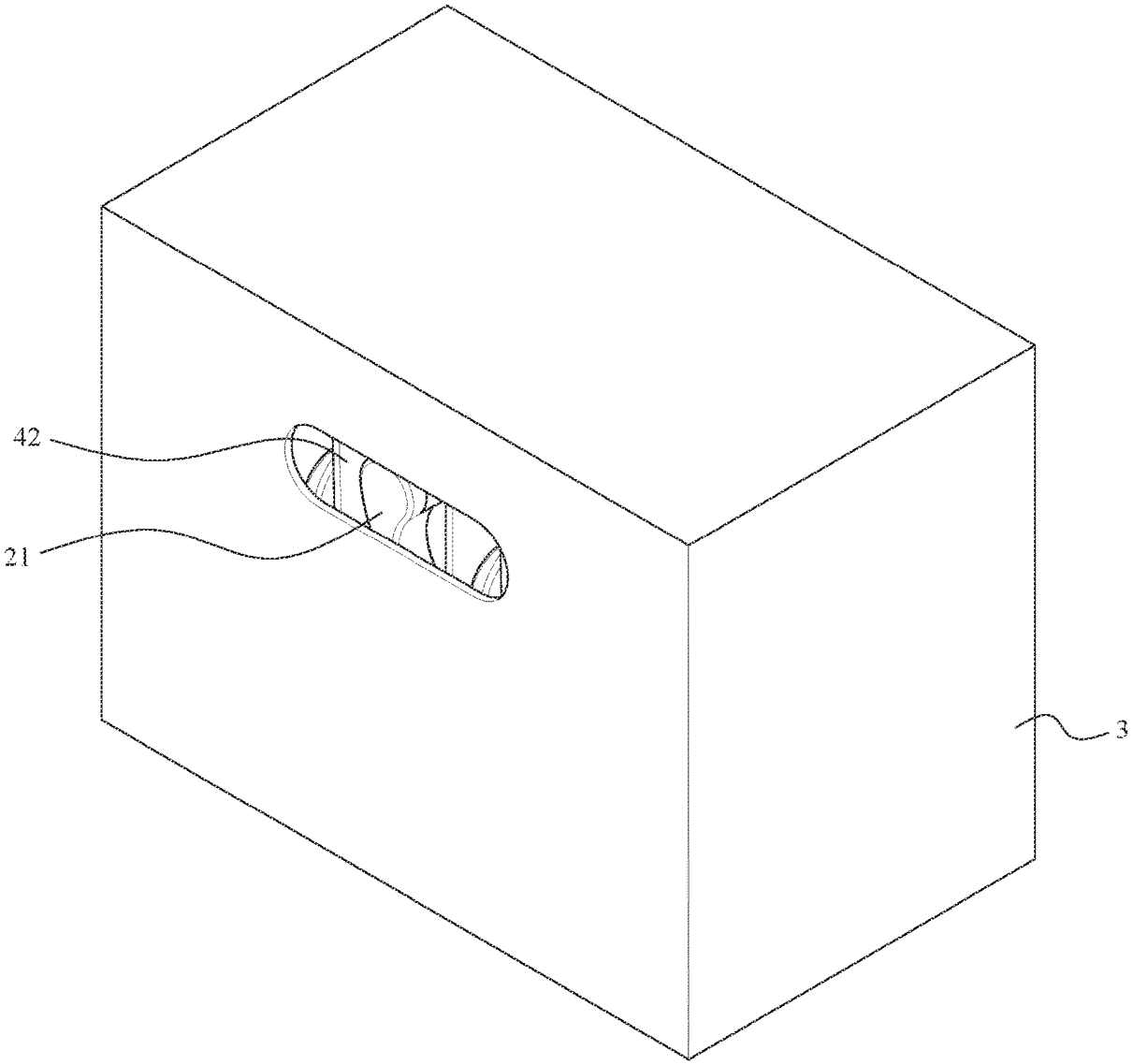
FIG. 10 is a perspective view to show that the piled support seats with locks are put in a lock packing box.

In order to prevent the operational ends 21 from being hit to cause scratches, as shown in FIGS. 6 to 8, at least one separator 4 is used which includes a bridge 41 transversely formed between two arms 42. The bridge 41 is located in the guide portion 121 of the support seat 1 at the lower position and can be slightly tilt or bent according to the position of the operation ends 21. The arms 42 are located between the two adjacent operational ends 21 of two locks 2. In one embodiment, the bridge 41 is located at the central portion of the separator 4, and the two arms 42 are formed on two ends of the bridge 41 to form an H-shaped separator 4. By the separator 4, the operational ends 21 contact the arms 42. The separator 4 is made of soft material such as paper board, so that when the operational ends 21 contact the arms 42, the arms 42 buffer the pressure and impact from outside to prevent scratches formed on the operational ends 21. In order to prevent the separator 4 from shifting transversely, the bridge 41 includes a dent 411 in a top edge thereof. When the support seats 1 are piled up, the dent 411 is engaged with the underside of the support seat 1 at the upper position, and located corresponding to the guide portion 121 of the support seat 1 at the lower position, such that the separator 4 does not shift transversely. The arms 42 ca be positioned between the adjacent operation ends 21 to protect the operational ends 21.

While we have shown and described the embodiment in accordance with the present invention, it should be clear to those skilled in the art that further embodiments may be made without departing from the scope of the present invention.

What is claimed is:

1. A lock packing box comprising:

multiple locks, at least one of the locks including two operational ends which are located corresponding to each other, a transmission part located between the two operational ends;

a separation structure located in the lock packing box and including at least one support seat, the at least one support seat having at least one passage defined transversely therethrough, at least two notches defined from a top of the at least one support seat, each notch including a guide portion and a positioning portion, the guide portion opening through the top of the at least one support seat and narrowing toward a root portion of the at least one support seat, the positioning portion communicating with the guide portion, said separation structure having at least one separator which includes a bridge transversely formed between two arms formed on two ends of said bridge, said bridge being located in the guide portion of the at least one support seat, said two arms being located between said two adjacent ends of two of said multiple locks; and, the transmission part of one of the locks engaged with the positioning portion via the guide portion so as to position the lock in the notch, the two operational ends of the lock located on two sides of the at least one support seat.

2. The lock packing box as claimed in claim 1, wherein the at least one support seat includes a board which is bent along a bending line, the at least one passage is formed by at least two holes of the board, the notch is formed by the board with at least two openings that communicate with each other.

3. The lock packing box as claimed in claim 1, wherein the operational ends of each lock are a lever handle or a knob handle.

4. The lock packing box as claimed in claim 1, wherein the support seats are piled up, the locks are positioned alternatively.

5. The lock packing box as claimed in claim 1, wherein the separation structure includes at least one plate which perpendicularly connected to the at least one support seat from an underside of the at least one support seat.

6. The lock packing box as claimed in claim 1, wherein the guide portion and the positioning portion form each notch as a Y-shaped notch, and the two arms are formed on two ends of the bridge to form an H-shaped separator.

* * * * *